10/17/78 XR 4,121,002

United States Patent [19]

Baldwin

[11] 4,121,002

[45] Oct. 17, 1978

[54] FABRICATION OF ANTENNA WINDOWS

[75] Inventor: R. Bruce Baldwin, Billerica, Mass.

[73] Assignee: The United States of America as represented by the Secretary of the Air Force, Washington, D.C.

[21] Appl. No.: 813,393

[22] Filed: Jul. 6, 1977

[51] Int. Cl.[2] ..... H01Q 1/42

[52] U.S. Cl. ..... 428/36; 156/643; 156/644; 264/136; 343/872; 427/227; 428/131

[58] Field of Search ..... 428/36, 188, 63, 67, 428/131-140; 343/872; 264/80, 136, 139; 427/140, 227, 289, 290; 138/97, 98, 146; 156/643, 644, 646, 668, 155

[56] References Cited

U.S. PATENT DOCUMENTS

| | | | |
|---|---|---|---|
| 2,474,201 | 6/1949 | Raymond et al. | 156/644 |
| 3,190,338 | 6/1965 | Wolfe | 428/63 |
| 3,509,571 | 4/1970 | Jones et al. | 343/872 |
| 3,618,112 | 11/1971 | Grove | 343/872 |
| 3,668,028 | 6/1972 | Short | 156/644 |
| 3,766,562 | 10/1973 | Pollin | 343/872 |
| 3,874,958 | 4/1975 | Scholtis et al. | 156/155 |
| 4,006,480 | 2/1977 | Charette et al. | 343/872 |

*Primary Examiner*—John E. Kittle

*Attorney, Agent, or Firm*—Joseph E. Rusz; Cedric H. Kuhn

[57] ABSTRACT

An integral antenna window is fabricated in a fiber-reinforced, resin matrix composite by the controlled localized removal of resin to provide a window area after which the area containing reinforcing fibers is impregnated with a second resin.

5 Claims, 6 Drawing Figures

FABRICATION OF ANTENNA WINDOWS

RIGHTS OF THE GOVERNMENT

The invention described herein can be manufactured and used by or for the Government of the United States for all governmental purposes without the payment of any royalty.

FIELD OF THE INVENTION

This invention relates to a method for fabricating an integral antenna window. In one aspect it relates to an antenna window formed as an integral part of a fiber-reinforced, resin matrix composite.

BACKGROUND OF THE INVENTION

Antenna windows in a fiber-reinforced, resin matrix composite are conventionally fabricated by initially cutting out an area of the composite corresponding to the desired shapes of the windows. Antenna windows of a like fibrous structure but a different resin matrix are then machined from separate pieces of composite material to conform to the cutout area. The windows so formed are then secured in the cutouts in the composite. This procedure for fabricating antenna windows results in discontinuities in the reinforcing fibers with a resultant reduction in mechanical properties as well as the presence of a joint between the composite and the antenna window.

It is an object of this invention to provide an antenna window which is an integral part of a fiber-reinforced, resin matrix composite.

Another object of the invention is to provide a method for fabricating an integrated antenna window.

Other objects and advantages of the invention will become apparent to those skilled in the art upon consideration of the accompanying disclosure and the drawing, in which.

SUMMARY OF THE INVENTION

In one embodiment, the present invention resides in a method for fabricating an antenna window in a fiber-reinforced, resin matrix composite. In accordance with the method a defined area of the composite corresponding to the desired window area is heated so as to remove resin therefrom. The area free from the resin matrix and containing reinforcing fibers is then impregnated with an electromagnetic-transparent resin to provide an integral antenna window.

In another embodiment, the invention lies in an antenna window which is an integral part of a fiber reinforced resin matrix composite.

Figure 1:
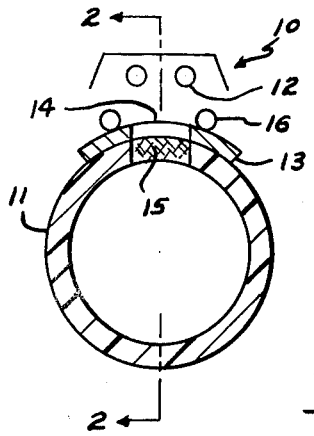
FIGS. 1 and 3 are schematic representations, partly in section, of apparatus used in fabricating the antenna window of this invention.

For a more complete understanding of the invention, reference is now made to the drawing in which identical reference numerals are used to designate the same elements in the several figures. As shown in FIG. 1, a source of radiant heat 10 is positioned above a fiber-reinforced, resin matrix composite 11 which, as illustrated, is cylindrical in shape. However, it is to be understood that the composite can be of other shapes, e.g., a planar or conical shape. It is usually preferred to utilize a quartz heating lamp 12 as the source of radiant heat although it is within the scope of the invention to employ any source capable of providing sufficient heat to char the resin matrix while leaving little or no residue.

Figure 5:
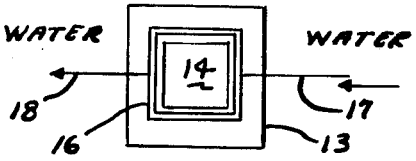
FIG. 5 is a plan view of the metal mask shown in FIGS. 1–4.

Positioned upon composite 11, and directly below radiant heat source 10, is a metal mask or plate 13 whose contour matches that of the cylinder. Mask 13 has an opening 14 therein of a shape corresponding to the desired shape of the antenna window, e.g., rectangular, square, circular, oval, etc. The mask can be maintained in position by any suitable fastening means, e.g., by means of hose clamps (not shown). Hatched area 15 designates the window area containing reinforcing fibers with the resin removed. A cooling coil 16 is attached, e.g., by welding or brazing, to the mask in close proximity to the periphery of opening 14. It is usually preferred to form the mask and cooling coil of copper although it is within the purview of the invention to use other metals or alloys such as steel or bronze. Also, the cooling coil may comprise a plurality of rings or spirals rather than the single one as shown. It is often desirable to coat the metal tubes of the cooling coil with a conductive filled epoxy resin in order to provide for improved heat transfer. In FIG. 5 there is illustrated a plan view of mask 13 with opening 14 and cooling coil 16. Attached to the coil are inlet and outlet lines 17 and 18 for the coolant which can be water or any other suitable coolant.

Figure 2:
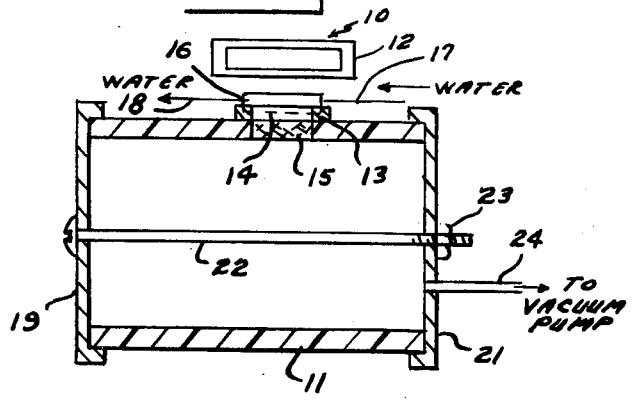
FIG. 2 is a cross sectional view taken along line 2—2 of FIG. 1.

As shown in FIG. 2, the ends of cylindrical composite 11 are enclosed with metal end caps 19 and 21 which can be formed of aluminum or other suitable metal. The end caps are conveniently held in place by means of a threaded rod 22 passing along the longitudinal axis of the cylinder. The rod is provided with a nut 23 which on being tightened secures the end caps in place on the cylinder ends. A line 24, attached to a vacuum pump (not shown), extends through end cap 21 and provides means for maintaining the interior of the cylindrical composite under a vacuum. The edges of the end caps and the rod holes therein are sealed with a suitable sealant, such as zinc chromate, to ensure maintenance of a vacuum. As will be described in more detail hereinafter, this vacuum system is utilized when heating of the exterior of the composite is in progress.

Figure 3:
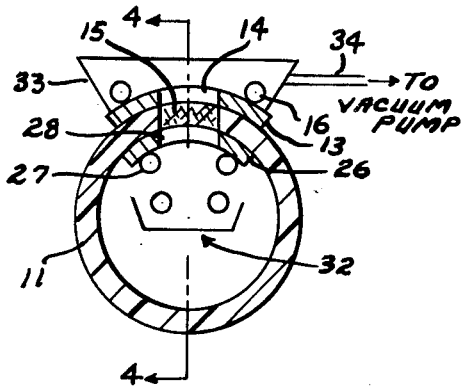
Figure 4:
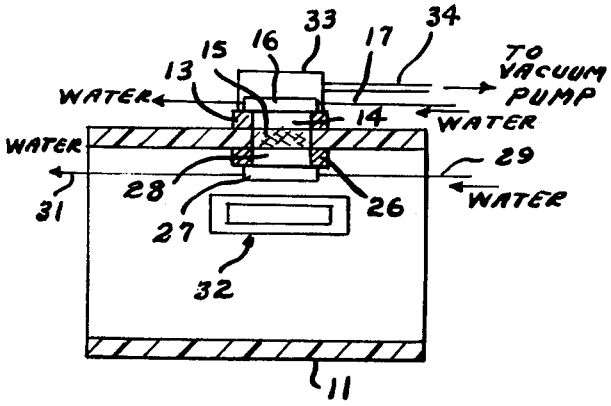
FIG. 4 is a cross sectional view taken along line 4—4 of FIG. 3.

Referring now to FIGS. 3 and 4, a metal mask 26 having a curvature conforming to the interior of the cylinder is attached to the interior of cylindrical composite 11. Mask 26 is essentially the same as mask 13 having a similar cooling coil 27 attached thereto and an identical opening 28 formed therein. Inlet and outlet lines 29 and 31 provide means for circulating a coolant, such as water, through the coil. Mask 26 can be maintained in position by any suitable holding means, e.g., by deep throated "C" clamps. When mask 26 is in position, its opening coincides with that of mask 13, i.e., opening 28 is directly below opening 14.

Disposed directly below mask 26 is a source 32 of radiant heat, which is similar to the one described above. A vacuum box 33 is attached to the exterior of the cylindrical composite or, as illustrated, to mask 13 so as to encompass openings 14 and 28 in the masks. The vacuum box, which can be held in place by hose clamps, is sealed along its edges with a sealant, such as zinc chromate, to ensure maintenance of a vacuum therein. Line 34 connected to a vacuum pump (not shown) provides means for maintaining a vacuum in the vacuum box. As will be described in more detail hereinafter, this vacuum system is utilized when heating of the interior of the composite is in progress.

Procedures for fabricating fiber-reinforced, resin matrix composites, e.g., by molding or casting, are well known in the art and do not per se constitute a part of the present invention. While the foregoing discussion has been concerned with a cylindrical composite, it is not intended to limit the method of this invention to the fabrication of an antenna window in a composite of any particular geometry. It is often preferred to utilize a three-dimensional fiber-reinforced, resin matrix composite, but the method of this invention is also applicable to two-dimensionally reinforced composite materials.

It is usually preferred to employ a phenolic resin and quartz fibers in fabricating the composite. However, resins other than phenolic resins can be used so long as they char cleanly or otherwise undergo thermal degradation. While glass fibers can be used instead of quartz fibers, they are generally inferior because of the presence of impurities. Phenolic resins are well known materials that are available from commercial sources. In general, the phenolic resins are resole resins prepared by condensing a phenol with an aldehyde in the presence of an alkaline catalyst.

In fabricating an antenna window utilizing the apparatus shown in FIGS. 1 through 4, heating of the composite surface can be initiated from either the exterior or interior of the cylindrical composite. However, in the ensuing description it is assumed the outer surface is initially heated, utilizing the apparatus shown in FIGS. 1 and 2.

With mask 13 in place as shown in FIG. 1, quartz heating lamp 12 is activated. As a result, radiant heat is directed toward opening 14 in the mask. In the meantime water is circulated through cooling coil 16. The circulating water (coolant) cools the mask and minimizes heating of the phenolic resin adjacent mask opening 14. Furthermore, during the heating period an internal vacuum is maintained in the cylindrical composite by means of the vacuum pump connected to line 24.

Radiant heat from the quartz lamp heats the phenolic resin in the area of opening 14 to a temperature below the glass transition temperature of the quartz reinforcing fibers. A temperature up to about 1800° F., e.g., a temperature ranging from about 1500° to 1800° F., is ordinarly used. An internal vacuum of about 5 to 10 inches of mercury is usually maintained during the heating period. As a result of the heating, the area of phenolic resin bounded by the perimeter of opening 14 chars or degrades uniformly and is thereby removed as a gaseous material. As soon as burn through occurs, hot gases are drawn through reinforcing fibers 15 as a result of the internal vacuum being applied. As the charring progresses, the flow of air caused by negative pressure across the heated zone increases the oxidation process by exposing the fibers to air. A monometer can be used with advantage to measure any change in vacuum as an indicator of burn through. The period of time required to obtain burn through varies as a function of fiber loading and resin density as well as flux and fluence of the heat source. In general, the time required to remove 0.5 inch of resin varies from about 30 to 60 minutes.

With thin section composites, e.g., less than 0.25 inch in thickness, resin removal can be accomplished by heating from one side only while still maintaining a substantially straight edge around the sides of the opening. With composites having a thickness greater than 0.25 inch, internal heating is also required to affect complete resin removal.

Internal heating is accomplished by employing the apparatus illustrated in FIGS. 3 and 4. Radiant heat from source 32 heats the phenolic resin remaining in the area of opening 28 in mask 26. During the heating period a vacuum is maintained in vacuum box 33, and water (coolant) is circulated through cooling coil 27. As illustrated, vacuum box 33 is positioned on metal mask 13 in which case water can advantageously circulate through coil 16. However, the vacuum box can be positioned directly upon the cylindrical composite, and metal mask 13 with its attached cooling coil 16 can be omitted during the internal heating.

The temperature and vacuum conditions maintained during internal heating are substantially the same as those maintained during external heating. Because of the applied vacuum, hot air passes through the openings in the metal mask, causing any remaining phenolic resin to degrade and carrying with it the resulting pyrolysis gases. Heating is continued until all of the phenolic resin is removed as indicated by the absence of pyrolysis gases. The heating period varies depending upon the amount of resin degraded during the external heating. With thicknesses greater than 0.25 inch, it is often preferred to remove about one-half of the resin by external heating and about one-half by internal heating. When operating in this manner, any tendency of the sides to taper is eliminated. The completeness of resin removal can be readily determined by viewing the opening in the composite with a high intensity light placed behind the opening.

The antenna window is completed by impregnating the reinforcing fibers in window area 15 with a resin having desired electromagnetic properties, i.e., one which is electromagnetic-transparent. It is usually preferred to use a polyformaldehyde, e.g., one having a melting point of about 350° F., as the impregnating resin.

Figure 6:
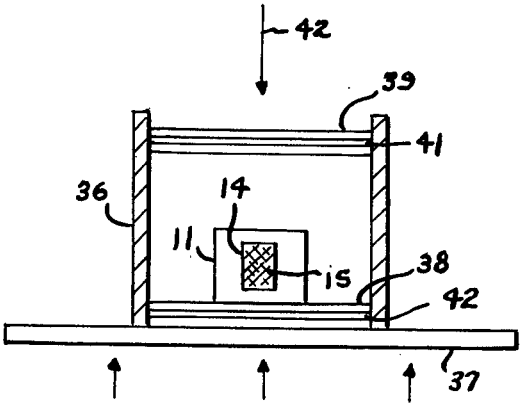
FIG. 6 is a schematic representation, partly in cross section, of apparatus used in fabricating the antenna window of this invention.

In a preferred procedure of resin impregnation, as shown in FIG. 6, cylindrical composite 11 is immersed in a heated mold 36 containing a boiling solution of polyformaldehyde in dimethylformamide. The mold is generally preheated to a temperature ranging from about 275 to 325° F. The solution usually contains about 65 to 75 weight percent dimethylformamide. The mold, shown as being disposed on platen 37, is provided with lower plug 38, on which the composite rests, and upper plug 39. The plugs are fitted with silicone rubber O-rings 41 and 42. The mold is pressurized to a pressure ranging from about 750 to 1250 psi by applying a load 42 to upper plug 39. The mold while under pressure is then allowed to cool to room temperature. Because of the high impregnation pressure, the polyformaldehyde is forced all around the quartz fibers for a tenacious bond.

After the mold has cooled, the composite is removed and excess polyformaldehyde is trimmed off, e.g., with a knife. The composite is then vacuum dried at 150° to 250° F. for a period of 8 to 24 hours. After drying any excess resin that may remain is machined off. As a result of the solvent removal, voids may be left in the polyformaldehyde resin. Because of any resultant porosity, it may be necessary to repeat the impregnation cycle, as described above, one or more times. Subsequent impregnations do not affect the in-place resin because the resin solution melts at a substantially lower temperature than does the resin itself.

Several advantages accrue from fabricating an antenna window in a fiber reinforced resin matrix composite in accordance with the above-described method of this invention. Of particular significance is the fact that the antenna window is formed as an integral part of the composite. There is thus a lack of joints and continuous rather than discontinuous reinforcing fibers, as required by separate windows, with attendant higher mechanical properties. The method makes it possible to achieve complete resin removal in a relatively short time without reaching the devitrification temperature of the reinforcing fibers.

As will be evident to those skilled in the art, modifications of the present invention can be made in view of the foregoing disclosure that falls within the spirit and scope of the invention.

I claim:

1. In a fiber-reinforced, resin matrix composite an antenna window comprising an opening in the composite having edges defining a predetermined shape, the opening being free of the resin matrix and containing the reinforcing fibers originally present in the composite prior to removal of resin to form the opening; and an electromagnetic-transparent resin filling the opening and being bonded to its edges and to the reinforcing fibers therein so that the resin is an integral part of the composite, lacking in joints and containing continuous reinforcing fibers.

2. The antenna window according to claim 1 in which the resin matrix is a phenolic resin matrix and the electromagnetic-transparent resin is a polyformaldehyde.

3. A method for fabricating an antenna window in a fiber-reinforced, resin matrix composite which comprises heating a defined area of the composite corresponding to a predetermined window area so as to remove resin therefrom while leaving intact the reinforcing fibers of the composite; and impregnating the area free from the resin matrix with an electromagnetic-transparent resin, thereby forming an antenna window which is an integral part of the composite, lacking in joints and containing continuous reinforcing fibers.

4. The method according to claim 3 in which the resin matrix is a phenolic resin matrix and the electromagnetic-transparent resin is a polyformaldehyde.

5. A method for fabricating an antenna window in a fiber-reinforced, phenolic resin matrix composite having opposed first and second surfaces which comprises the following steps:

(a) heating a selected area of predetermined geometry of the first surface of the composite at a temperature sufficient to char the phenolic resin within the area;
(b) applying a vacuum to the selected area;
(c) continuing to heat the selected area and to apply a vacuum to the selected area until at least one-half of the phenolic resin in the area between the first and second surfaces is degraded and removed as pyrolysis gases;
(d) terminating the heating and the application of vacuum;
(e) heating an area of the second surface identical in shape to and directly opposite to the selected area of the first surface;
(f) applying a vacuum to the area of the second surface;
(g) continuing to heat the area of the second surface and to apply a vacuum thereto until all remaining phenolic resin in the area between the first and second surfaces is degraded as indicated by absence of pyrolysis gases;
(h) terminating the heating and the application of vacuum;
(i) recovering the composite having an opening therein with a shape corresponding to the selected area and containing the reinforcing fibers originally present in the composite prior to removal of resin to form the opening; and
(j) impregnating the opening with a polyformaldehyde so as to form an antenna window which is an integral part of the composite and is lacking in joints and contains continuous reinforcing fibers.

* * * * *